US006144019A

United States Patent [19]

Garcia et al.

[11] Patent Number: 6,144,019

[45] Date of Patent: Nov. 7, 2000

[54] INDUCTOR FOR AN INDUCTION COOKING AREA

[75] Inventors: Jose-Ramon Garcia, Saragossa, Spain; Markus Theine, Freilassing, Germany; Pablo Hernandez, Saragossa, Spain

[73] Assignee: BSH Bosch und Siemens Hausgeraete GmbH, Munich, Germany

[21] Appl. No.: 09/396,926

[22] Filed: Sep. 15, 1999

[30] Foreign Application Priority Data

Oct. 5, 1998 [DE] Germany ..... 198 45 844

[51] Int. Cl.[7] ..... H05B 6/12; H05B 6/44

[52] U.S. Cl. ..... 219/624; 219/675; 219/671; 336/220; 336/232

[58] Field of Search ..... 219/624, 622, 219/623, 675, 662, 671, 676; 336/220, 232

[56] References Cited

U.S. PATENT DOCUMENTS

| | | | |
|---|---|---|---|
| 3,843,857 | 10/1974 | Cunningham | 219/624 |
| 4,296,295 | 10/1981 | Kiuchi | 219/624 |
| 4,453,067 | 6/1984 | Karklys et al. | 219/624 |
| 5,369,249 | 11/1994 | Kwon | 219/624 |
| 5,528,020 | 6/1996 | Dickens et al. | 219/621 |
| 5,686,006 | 11/1997 | Gaspard | 219/622 |

FOREIGN PATENT DOCUMENTS

| | | | |
|---|---|---|---|
| 2 200 489 | 7/1972 | Germany . | |
| 28 06 825 A1 | 8/1979 | Germany . | |
| 196 04 436 A1 | 8/1997 | Germany . | |
| 5-41274 | 2/1993 | Japan | 219/624 |

OTHER PUBLICATIONS

International Patent Application WO 89/04109 (Axelson), dated May 5, 1989.

*Primary Examiner*—Philip H. Leung
*Attorney, Agent, or Firm*—Herbert L. Lerner; Laurence A. Greenberg; Werner H. Stemer

[57] ABSTRACT

An inductor module for disposition below a cooking area plate of an inductor cooking area is disclosed. The inductor module includes a plate-shaped substrate and at least two inductor coils including a first inductor coil and a second inductor coil formed as flat conductor tracks mounted on opposed sides of the plate-shaped substrate. The inductor coils are further disposed spaced apart from and one above the other.

9 Claims, 1 Drawing Sheet

INDUCTOR FOR AN INDUCTION COOKING AREA

BACKGROUND OF THE INVENTION

Field of the Invention

The present invention relates to an inductor for disposition below a cooking area plate on an inductor cooking area having at least two inductor coils, which are disposed spaced apart from and one above the other.

One such inductor is known from published International Patent Disclosure WO 89/04109. The configuration and disposition of the inductor coils is such that at each point of the field outside the cooking region to be heated, which point is covered by the pot set on it, the field components of the individual inductor coils essentially cancel one another out. To that end, the inductor coils disposed under one another have the supplied current flowing in opposite directions through them. Furthermore for shielding off the interfering field of the lower inductor coil, a suitable ferrite element is disposed between the two inductor coils. From Published, Non-Prosecuted German Patent Application DE 196 04 436 A1, an inductor to be installed below a recessed plate with an inductor coil is also known, which is retained on a plastic carrier part. The inductor coil is equipped with a thermal and/or electrical insulation and with a temperature sensor, electrically insulated from the recess plate, for measuring a recessed plate temperature. The self-supporting inductor coil, of fine-wire braid, is wound in a spiral essentially on a bearing face of the carrier part.

SUMMARY OF THE INVENTION

It is accordingly an object of the invention to provide an inductor for an induction cooking area which overcomes the above-mentioned disadvantages of the prior art devices of this general type, in which an inductor is furnished with the lowest possible minimum structural height.

With the foregoing and other objects in view there is provided, in accordance with the invention, an inductor module for disposition below a cooking area plate of an inductor cooking area, including a plate-shaped substrate; and at least two inductor coils including a first inductor coil and a second inductor coil formed as flat conductor tracks mounted on opposed sides of the plate-shaped substrate and disposed spaced apart from and one above the other.

By turning away from the previous use of wound braids, wires or copper strips for the inductor coil, the structural height of the inductor can be virtually halved while the lateral length of the inductor remains virtually unchanged. To enable furnishing an adequate conductor cross section of the inductor coil, at least two inductor coils are disposed one above the other. The electromagnetic field, engendered by the inductor coils through which current flows, for heating a pot set on the cooking area plate, is sufficiently great if the two inductor coils are disposed with the least possible spacing from the bottom of the pot.

Advantageously, the material of the substrate is an oxide ceramic, in particular an aluminum oxide. As a result, an excellent insulator with good thermal conduction properties for the inductor is furnished. Because of this property, the local heating of the inductor, caused by the intrinsic heating of the coil and by the external heat supplied, for instance by the pot or by the glass ceramic, is distributed faster. Furthermore, the heat is output to the surroundings over a larger surface area. This is especially dictated by the disposition of the conductor tracks of the inductor coil, which excels because the flat conductor track is oriented with its large-area top side away from the substrate or the neighboring windings. Only the small-area side faces of adjacent windings are disposed adjacent one another.

An oxide ceramic is also especially well suited to the application of flat conductor tracks. To assure adequate stability of the inductor applied to the underside of the substrate, the substrate itself, and not to weaken the field of the inductor coil too much as a result of its being spaced part from the pot to be heated, the thickness of the substrate is approximately 0.7 to 1 mm.

In a preferred embodiment, the inductor coil is applied as an inductor spiral by a coating technique, in particular a thick-film coating, to the substrate. With the thick-film coating technique, and in particular a multi-layer thick-film coating technique, the inductor coil can be realized with an adequate conductor cross section in a simple way in terms of its production. Alternatively, conductor plate etching techniques, or mechanically made flat-strip coils, or other known production techniques can be employed. Because of the locally especially firm bonding and because of the use of techniques involving pressure or etching of the conductor track to the ceramic substrate with its low coefficients of temperature-dictated lengthwise expansion, differences in the power of the coil, which are due to different geometric states in the cold or hot state of the inductor, are extraordinarily slight.

Layer thicknesses in the range of approximately 0.5 mm are especially desirable. These are still readily feasible from a production standpoint, and are also great enough to enable assuring a suitable quality of the inductor coil. Copper, because of its good electrical conduction properties, is especially suitable as the material.

Particularly through the use of coating or etching techniques, it is possible in a simple way from the production standpoint for the spacing of the windings of the conductor track of the spiral inductor coil to vary from its center to its peripheral region. Because of the flexible placing of the spacings, a targeted field distribution or heat distribution of the inductor is possible. Also when coating or etching techniques are employed, multi-zone inductors or segmented inductor coils, which are known per se, with optimized heat distribution can be economically realized. A further advantage is that the slight production variations in such production processes guarantee that there will be only slight differences in terms of coil properties, such as inductance, of the mass-produced inductors.

For the sake of electrically conductively connecting the two inductor coils, the substrate has through-contacted openings. The openings are simple to produce and also enables electrically interconnecting even numerous coil segments that may be present on the top and bottom sides of the substrate with one another in series and/or parallel circuits, as desired.

To realize the self-heating of the inductor, the spiral conductor track of one inductor coil is disposed essentially spatially in the spiral region between the individual windings of the conductor track of the other inductor coil. The defined offset between the upper and lower metal-covered faces of the inductor coil is attainable without problems, especially using coating or etching techniques known per se. Advantageously, the two inductor coils are embodied essentially geometrically identically and are disposed essential one above the other. The electrical current also flows through them in the same direction, so that the strongest possible field of the inductor coil for heating the bottom of a pot set down on the cooking area can be furnished.

The structure of the inductor coil is especially compact and easily manipulated in the process of producing the cooking area if the two inductor coils are prefabricated as a module, together with insulation disks and ferrite elements disposed on both sides, to make a shallow structural unit.

Other features which are considered as characteristic for the invention are set forth in the appended claims.

Although the invention is illustrated and described herein as embodied in an inductor for an induction cooking area, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
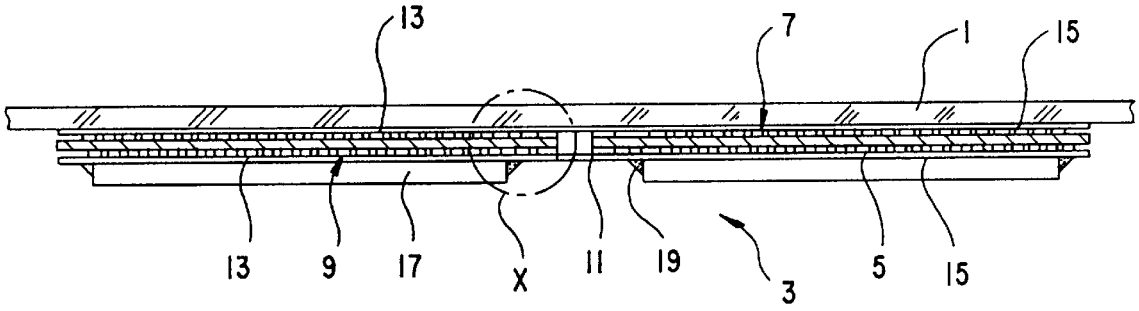
FIG. 1 is a diagrammtic, sectional view of an inductor disposed under a cooking area plate according to the invention.

In all the figures of the drawing, sub-features and integral parts that correspond to one another bear the same reference symbol in each case. Referring now to the figures of the drawing in detail and first, particularly, to FIG. 1 thereof, there is shown a cooking area that has a glass ceramic plate 1, under which an inductor 3 is retained, in a region of a marked cooking location. The inductor 3 has a circular substrate plate 5 of aluminum oxide, with a thickness of approximately 0.8 mm, which is coated on both sides. While a first spiral copper inductor coil 7 is applied by thick-film coating to a top side of the substrate plate 5, an underside of the ceramic substrate plate 5 is coated with an also spiral second inductor coil 9 of copper material. For electrically conductively joining the two inductor coils 7, 9 in their middle, the substrate plate 5 has a bore 11, approximately at its center point, which is embodied as an electrically conductive through-contacting opening 11. A spacing of the windings of flat copper conductor tracks 13 of the two spiral inductor coils 7, 9 is not selected to be uniform over the entire surface of the inductor coils 7, 9. As a result, it is possible on the one hand to vary the heat distribution in the inductor 3 or the substrate plate 5 in a targeted way, and on the other, the field distribution attained by the inductor coils 7, 9 can be adjusted in a targeted way. To further reduce the intrinsic heating of the coils 7, 9 or of the substrate plate 5, the conductor tracks 13 of the two inductor coils 7, 9 are disposed in partly offset fashion. Because of the virtually identical spiral shape of the two coils 7, 9, the virtually identical stacked configuration of the two inductor coils 7, 9, and in particular the flow of the supplied current through the inductor coils 7, 9 in the same direction, and given a shallow inductor structure and a conventional lateral length of the inductor 3, a sufficiently strong field of the inductor 3 is assured. As electrical insulation, one micanite disk 15 each, approximately 0.5 mm thick, is glued to the top and bottom sides of the inductor 3. In addition, ferrite rods 17 known per se are elastically glued to the underside of the inductor 3, onto the micanite disk 15, by a silicone adhesive 19 in order to provide additional conduction of the induction field. The resultant inductor structure, while having adequate electrical properties, has an overall height of only about 5 to 6 mm.

Figure 2:
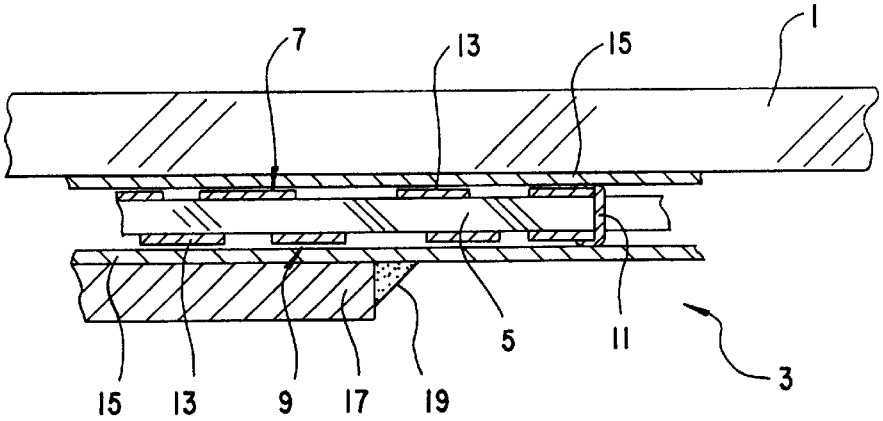
FIG. 2 is an enlarged, sectional view of the detail marked X in FIG. 1.

FIG. 2 shows a detailed view of the area marked X in FIG. 1.

We claim:

1. An inductor module for disposition below a cooking area plate of an inductor cooking area, comprising:

a plate-shaped substrate formed of an oxide ceramic; and at least two inductor coils including a first inductor coil and a second inductor coil formed as flat, spiral conductor tracks having individual windings, being mounted on opposed sides of said plate-shaped substrate, and being disposed spaced apart from and one above the other, said at least two inductor coils applied as inductor spirals to said plate-shaped substrate by a coating technique, and a respective spiral conductor track of said first inductor coil being disposed substantially spatially in a spiral region between said individual windings of a respective conductor track of said second inductor coil.

2. The inductor module according to claim 1, wherein said plate-shaped substrate has a thickness between approximately 0.7 to 1 mm.

3. The inductor module according to claim 1, wherein said flat conductor tracks have windings each with a center point and a peripheral region and a spacing of said windings varies from said center point to said peripheral region.

4. The inductor module according to claim 1, wherein said plate-shaped substrate has a through-contacted opening formed therein which conductively connects said at least two inductor coils to one another.

5. The inductor module according to claim 1, wherein said at least two inductor coils are embodied substantially geometrically identically, are disposed substantially identically one above the other, and have electric current flowing through them in a same direction.

6. The inductor module according to claim 1, including:

insulation disks disposed on one side of each of said first inductor coil and said second inductor coil; and ferrite elements disposed on at least one of said insulation disks, said at least two inductor coils, said insulation disks and said ferrite elements together form a flat structural unit.

7. The inductor module according to claim 1, wherein said plate-shaped substrate is formed of an aluminum oxide.

8. The inductor module according to claim 1, wherein said at least two inductor coils are applied as inductor spirals by a thick-film coating technique to said plate-shaped substrate.

9. A cooking area with a cooking area plate, comprising:

a plate-shaped substrate formed of an oxide ceramic; and at least two inductor coils including a first inductor coil and a second inductor coil formed as flat, spiral conductor tracks having individual windings, being mounted on opposed sides of said plate-shaped substrate, and being disposed spaced apart from and one above the other, said at least two inductor coils applied as inductor spirals to said plate-shaped substrate by a coating technique, and a respective spiral conductor track of said first inductor coil being disposed substantially spatially in a spiral region between said individual windings of a respective conductor track of said second inductor coil.

* * * * *